US005234037A

United States Patent [19]

Derby

[11] Patent Number: 5,234,037

[45] Date of Patent: Aug. 10, 1993

[54] VACUUM FILL SYSTEM

[75] Inventor: Norwin C. Derby, Sherman, Tex.

[73] Assignee: B.A.G. Corporation, Dallas, Tex.

[21] Appl. No.: 875,636

[22] Filed: Apr. 28, 1992

Related U.S. Application Data

[63] Continuation of Ser. No. 558,678, Jul. 27, 1990, abandoned, which is a continuation-in-part of Ser. No. 407,901, Sep. 15, 1989, abandoned.

[51] Int. Cl.[5] ..... B65B 1/26

[52] U.S. Cl. ..... 141/67; 141/65; 141/71; 141/51; 222/394; 222/637; 414/221

[58] Field of Search ..... 141/5, 7, 8, 4, 10–12, 141/43, 50, 51, 48, 57, 59, 61, 67, 68, 71, 73, 80, 65; 222/442, 445, 447, 450, 394, 637; 414/217, 221

[56] References Cited

U.S. PATENT DOCUMENTS

| | | | |
|---|---|---|---|
| 2,138,356 | 11/1938 | Ryan et al. | 141/7 |
| 2,142,990 | 1/1989 | Belcher . | |
| 2,720,375 | 10/1955 | Carter | 141/68 X |
| 2,780,247 | 2/1957 | Claassen, Jr. | 141/7 |
| 2,783,786 | 3/1957 | Carter | 141/51 |
| 2,815,621 | 12/1957 | Carter . | |
| 2,964,070 | 12/1960 | Linhardt . | |
| 3,063,477 | 11/1962 | Vogt | 141/67 X |
| 3,232,494 | 2/1966 | Poarch . | |
| 3,258,041 | 6/1966 | Lau | 141/68 X |
| 3,260,285 | 7/1966 | Vogt | 141/8 |
| 3,542,091 | 11/1970 | Carter . | |
| 3,586,066 | 6/1971 | Brown . | |
| 3,589,411 | 6/1971 | Vogt . | |
| 3,605,826 | 9/1971 | Carter | 141/5 |
| 3,785,410 | 1/1974 | Carter . | |
| 3,788,368 | 1/1974 | Geng et al. | 141/67 |
| 3,847,191 | 11/1974 | Aronson . | |
| 4,060,183 | 11/1977 | Puurunen . | |
| 4,182,386 | 1/1980 | Alack . | |
| 4,185,669 | 1/1980 | Jevakohoff . | |
| 4,219,054 | 8/1980 | Carter et al. . | |
| 4,457,125 | 7/1984 | Fishburne . | |
| 4,526,214 | 7/1985 | McGregor . | |
| 4,545,410 | 10/1985 | Paul et al. | 141/67 X |
| 4,573,504 | 3/1986 | Rosenstrom | 141/59 |
| 4,614,213 | 9/1986 | Englin . | |
| 4,648,432 | 3/1987 | Mechalas . | |
| 4,854,353 | 8/1989 | Russell . | |
| 4,912,681 | 3/1990 | Halsey et al. . | |
| 5,109,893 | 5/1992 | Derby . | |

FOREIGN PATENT DOCUMENTS

| | | | |
|---|---|---|---|
| 1265286 | 5/1961 | France | 141/10 |

*Primary Examiner*—Henry J. Recla
*Assistant Examiner*—Casey Jacyna
*Attorney, Agent, or Firm*—Michael A. O'Neil

[57] ABSTRACT

A vacuum fill system for deaerating flowable materials includes a hollow, cylindrical container connected to a plurality of valves, slide gate valves and a vacuum pump for creating a vacuum when filled with flowable materials that causes the flowable materials to deaerate and subsequently compact when atmospheric pressure is restored.

15 Claims, 4 Drawing Sheets

VACUUM FILL SYSTEM

RELATED APPLICATION

This application is a continuation of application Ser. No. 07/558,678, filed Jul. 27, 1990, now abandoned, which was a continuation-in-part of application Ser. No. 07/407,901, filed Sep. 15, 1989, now abandoned.

TECHNICAL FIELD OF THE INVENTION

This invention relates to a vacuum fill system for deaerating flowable materials for storage in a container, and in particular, to a vacuum fill system for deaerating and compacting flowable materials used in flexible bulk containers.

BACKGROUND OF THE INVENTION

Containers used in the storage, transportation, and dispensation of flowable materials have been around for as long as civilization itself. The use of such containers, however, has always been limited by (1) the weight, density, and other physical properties of the material being stored, and (2) by the process and type of container used to store the material.

Traditional filling processes and containers have long been encumbered by a simple phenomenon that has exasperated consumers for decades—settling. Settling, as any purchaser of a bag of potato chips knows, means the bag is never completely filled when opened. This occurs due to the settling of the product inside during its filling and shipment. This simple settling phenomenon causes tremendous economic waste each year because of the misuse of storage space and container materials. This has been particularly true in the storage, transportation, and dispensation of flowable materials in semi-bulk quantities such as grains, chemicals and other bulky substances stored in flexible, bulk containers, such as those disclosed in U.S. Pat. Nos. 4,143,796 and 4,194,652.

It has long been known that the settling process is caused by the natural aeration of flowable materials as the materials are placed inside a container. As the container is shipped to its final destination, the air escapes from the aerated material mixture causing the product to compact and reduce in volume. Thus, when the container is opened, the flowable material has settled to the bottom of the container, i.e. the bag of potato chips is only half full.

Any process or system, such as the present invention, for storing materials in a container for shipment that allows all of the container to be filled with product and eliminates the excess air results in an enormous cost savings. Indeed, the shipment of smaller sized containers using vacuum sealed packages such as, e.g., vacuum sealed coffee containers, has alleviated many of the above problems of cost and time.

Although vacuum sealed packaging has proved to be an efficient, cost-saving and consumer pleasing method of shipping small quantities of goods, before now, it has been impossible to apply such techniques into other areas of storage, transportation and dispensation of flowable materials. This has been particularly true in the market for semi-bulk flowable materials.

The present invention, however, substantially eliminates settling and the inherent problems associated therewith by providing a vacuum filling system that deaerates the flowable material during filling. The present invention thus allows more product to be transported in the same size container than is possible using prior techniques.

Additionally, by utilizing all of the container space, the present invention allows for the far more efficient total use of all of the container materials and space. No longer is money being spent for container material that is not used. Therefore, the present invention overcomes many of the difficulties inherent in prior filling systems.

SUMMARY OF THE INVENTION

The present invention relates to a vacuum filling system for deaerating flowable materials, and in particular, to a vacuum system for use with flexible bulk containers used to store, transport and dispense flowable materials in semi-bulk quantities.

The vacuum fill system of the present invention generally comprises a first container for holding the flowable material; means for controlling the flow of the flowable material into the first container; means for creating a vacuum in the first container for deaerating the flowable materials; means for compacting the deaerated material; and means for controlling the flow of the deaerated, compacted flowable material from the first container into a storage container for shipment.

In the preferred embodiment of the invention, a first conventional slide or knife gate and valve assembly is located at one end of the first container for controlling the flow of flowable materials into the first container. A conventional vacuum pump, capable of pulling a vacuum of eighteen (18) inches of mercury, for deaerating the flowable materials is connected to the first container through a series of butterfly valves and vacuum lines. A second conventional slide or knife gate and valve assembly is located at the opposite end of the first container for controlling the flow of deaerated flowable material into the storage container.

Operation of the vacuum fill system is simple and easy. The flowable material is placed inside of the first container. A vacuum is created through the use of a plurality of valves and a conventional vacuum pump. After sufficient deaeration of the flowable material is achieved, the vacuum is released and the interior of the container is returned to atmosphere pressure substantially instantaneously causing the material to compact. The compacted, deaerated flowable material then drops from the first container into a flexible container for shipment. In a second embodiment of the invention, compressed air is introduced into the first container to force the compacted, deaerated flowable material from the first container into the flexible container.

By deaerating and compacting the flowable material before filling the flexible container, through the use of the vacuum fill system, the flowable material is presettled and will not settle during shipment. Thus, the present invention allows for complete utilization of the flexible container, eliminating wasted space and allowing for the shipment of more material without any increase in the container volume. Therefore, the present invention has numerous advantages over the prior art.

BRIEF DESCRIPTION OF THE DRAWINGS

A more complete understanding of the invention may be had by reference to the following Detailed Description when taken in conjunction with the accompanying Drawings, in which.

DETAILED DESCRIPTION OF THE INVENTION

Figure 1:
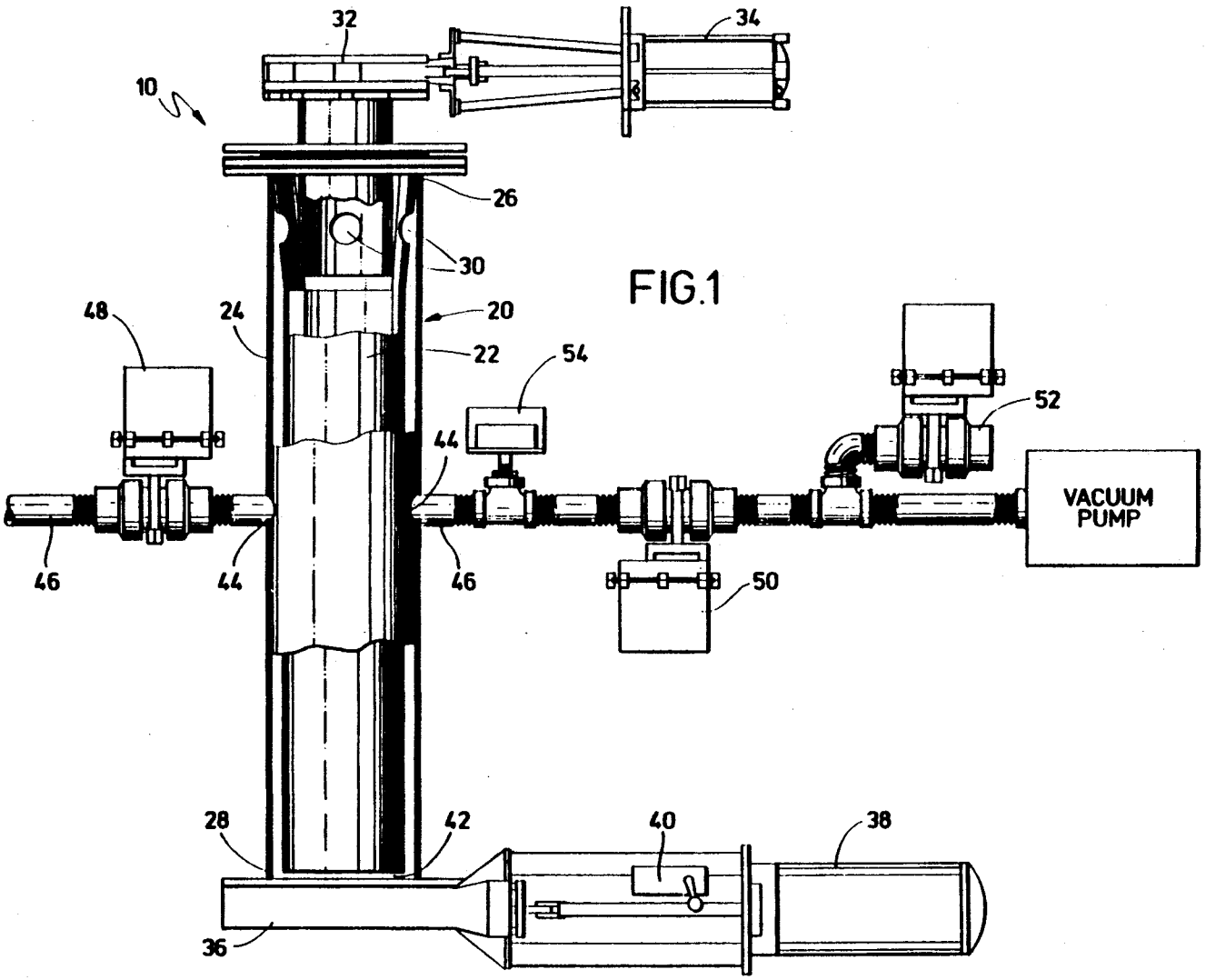
FIG. 1 is a partial sectional view of the vacuum fill system.

Referring to FIG. 1, the vacuum fill system 10 has a hollow, cylindrical container 20, having inner and outer chambers 22 and 24, respectively. Chambers 22 and 24 have first and second ends 26 and 28. The inner chamber 22 connects with the outer chamber 24 at the first end 26 of the two chambers. In the preferred embodiment, the inner chamber 22 has a plurality of openings 30 which allow for the venting of air during use. The inner chamber 22 may also be made of a perforated or woven material to allow for better evacuation and compaction.

Attached to the first end 26 of the hollow, cylindrical container 20 and its inner and outer chambers 22 and 24 is a conventional knife or slide gate valve 32 and associated air cylinder 34 which controls the opening and closing of the gate 32. The slide gate valve 32 and air cylinder 34 are of conventional types well known in the art. When the gate valve 32 is in the open position, flowable material flows through the gate valve 32 and into inner chamber 22 of the hollow, cylindrical container 20.

At the second end 28 of the hollow, cylindrical container 20, there is a second slide or knife gate valve 36, which is normally of a slightly larger diameter than slide gate valve 32. The slide gate valve 36 also has associated with it an air cylinder 38 and switch 40, both well known in the art, which are utilized to open or close the slide gate valve 36 to allow flowable materials to exit from the hollow, cylindrical container 20 after deaeration and compaction. Also at the second end 28 of the container 20, is a gap 42 between the bottom of the inner chamber 22 and outer chamber 24 of the container 20. The gap 42 allows air to vent and is utilized to help form a vacuum during the deaeration process.

The outer chamber 24 of the hollow, cylindrical container 20 has a plurality of openings 44 into which vacuum lines 46 run. The vacuum lines 46 do not, however, connect to the inner chamber 22. In the preferred embodiment of the invention, there are at least two openings 44 and two vacuum lines 46 running in opposite directions. One of the vacuum lines 46 is connected to a solenoid actuated butterfly valve 48 which in turn connects to a conventional dust collector (not shown). The second vacuum line 46 is connected to a series of solenoid actuated butterfly valves 50 and 52, and from there to a conventional vacuum pump (not shown).

Although any conventional vacuum pump may be utilized with the present invention, the vacuum pump must be capable of pulling a minimum of eighteen (18) inches of mercury during operation. Also connected to the second vacuum line 46 is a conventional pressure switch 54, which is utilized to control the opening and closing of the valves 50 and 52.

FIGS. 2 through 5 illustrate the operation of the vacuum fill system of the present invention. Although the vacuum fill system 10, illustrated in FIGS. 2 through 5, is used in connection with the filling of a semi-bulk container for handling flowable materials, it must be understood that the present invention is capable of being utilized with any type of container no matter how large or small where it is desired to compact, deaerate and densify the flowable materials for packing into a container for shipment and storage.

Figure 2:
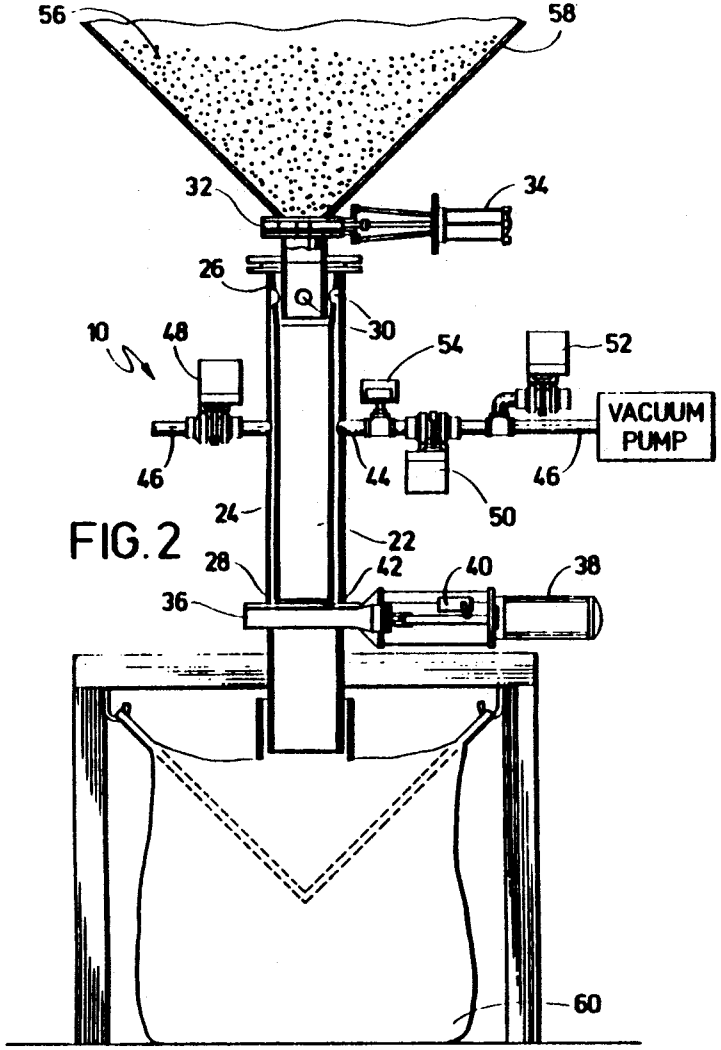
FIG. 2 is a partial sectional view of the vacuum fill system illustrating its use with semi-bulk bags used for containing flowable materials.
Figure 5:
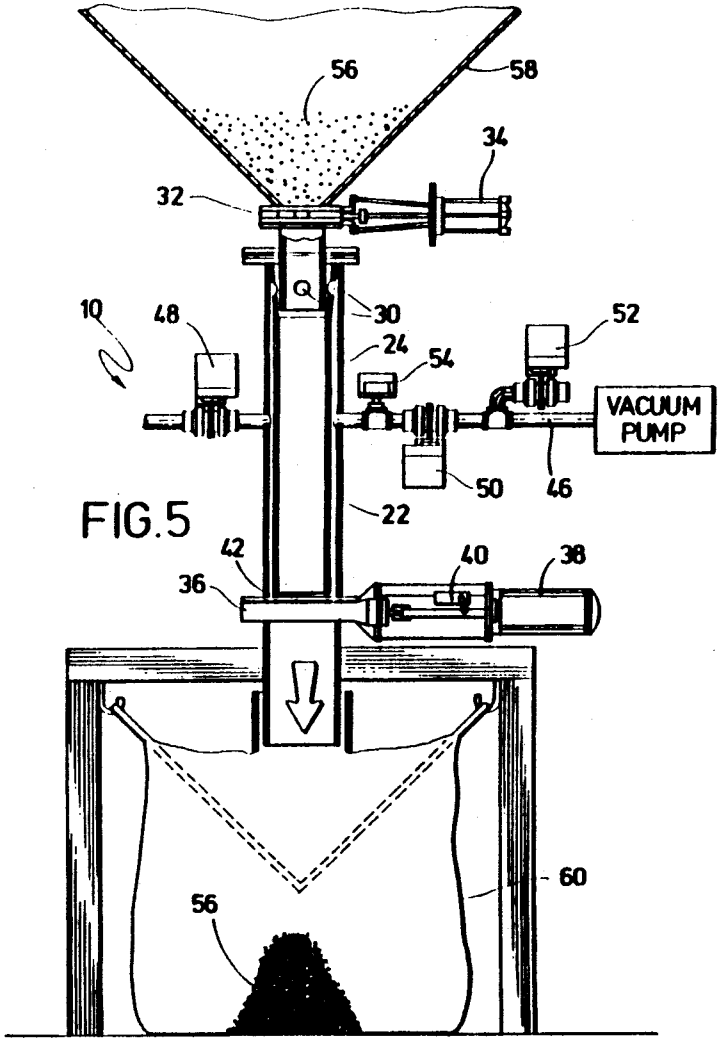
FIG. 5 is a partial sectional view of the vacuum fill system illustrating the deaerated flowable material inside the storage container.

Turning now to FIG. 2, therein is illustrated the initial start up position of the vacuum fill system 10.

In FIG. 2, valves 32, 36, 48 and 50 are closed. The flowable material 56 is contained within a conventional holding/storage device 58, such as a hopper. The vacuum fill system 10 is connected to a semi-bulk bag 60 through conventional means.

Figure 3:
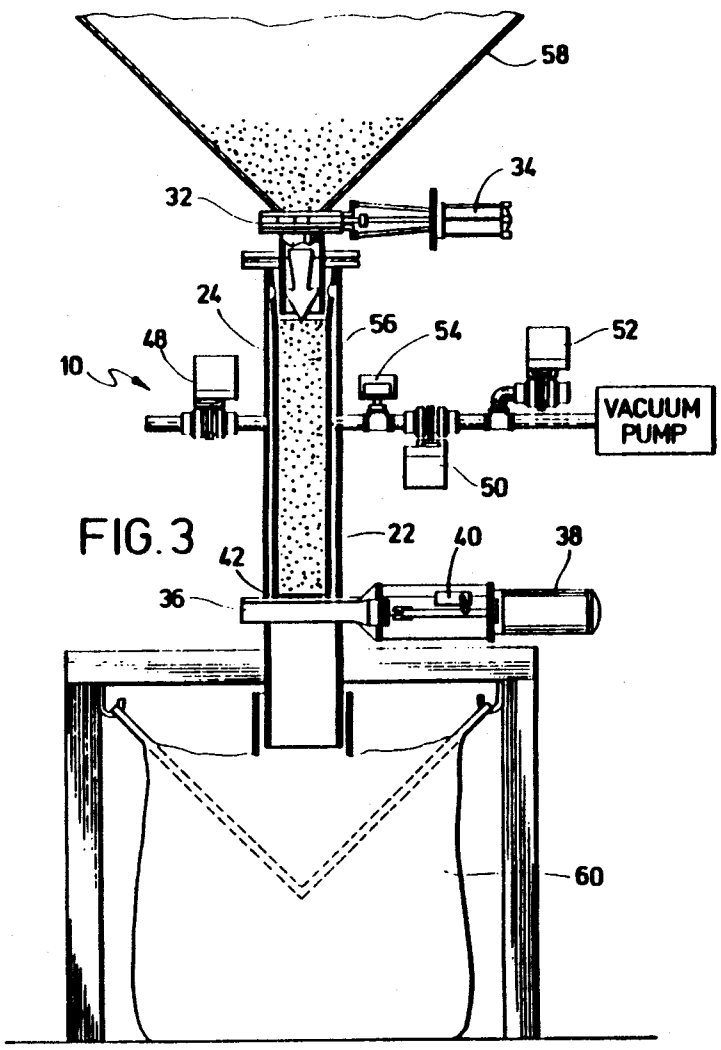
FIG. 3 is a partial sectional view of the vacuum fill system illustrating the filling of the first container with flowable material before deaerating.

Turning to FIG. 3, therein it is shown that the hollow, cylindrical container 20 has been filled with flowable material 56. In order to fill the hollow container 20, valves 32 and 48 have been opened. This results in the opening of slide gate valve 32 and the venting of air through valve 48 to the dust collector during the filling process. Once slide gate valve 32 is opened, the flowable material fills the inner chamber 22 up to the level of the openings 30. Openings 30 and gap 42 allow the dust to be vented to the dust collector through valve 48 and vacuum lines 46.

The flow of flowable materials into the inner chamber 22 is controlled either by weight or height level. When the predetermined level or weight is reached, valve 32 automatically closes preventing the flow of further flowable material 56 into the inner chamber 22 of the hollow, cylindrical container 20.

At this time, valves 48 and 52 are also closed automatically and valve 50 is opened. This creates a vacuum in the space between the inner and outer chambers 22 and 24.

Figure 4:
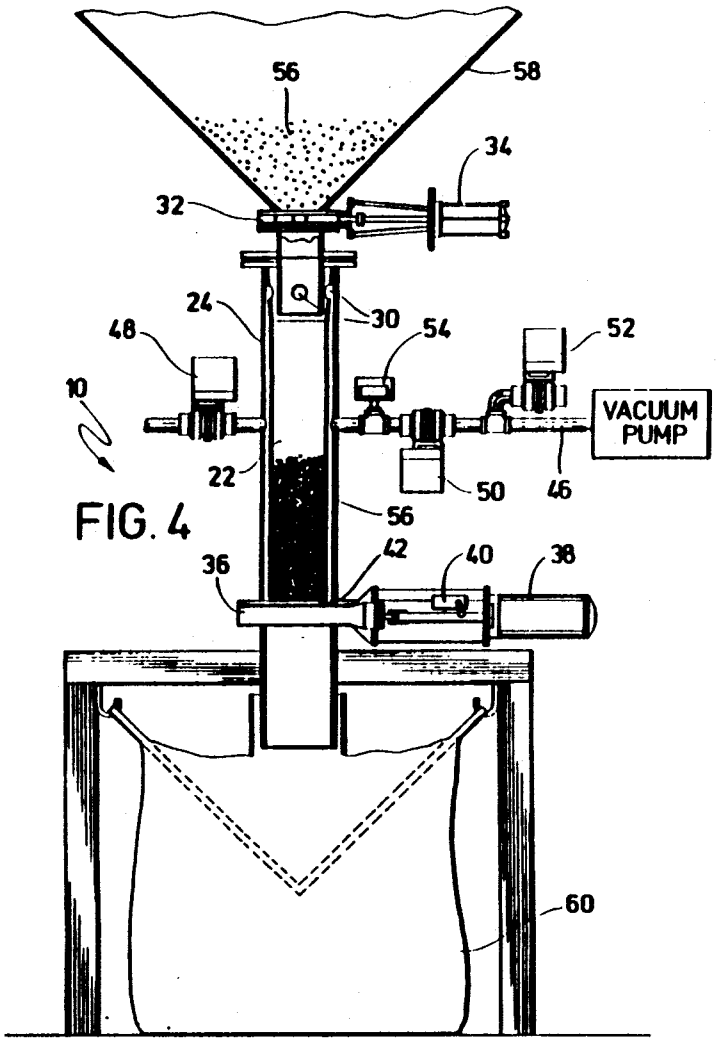
FIG. 4 is a partial sectional view of the vacuum fill system illustrating the deaerated flowable material.

Turning to FIG. 4, therein is illustrated that flowable material 56 has been deaerated and compacted and that the volume of material 56 is now significantly less than when first introduced into the hollow, cylindrical container 20.

When the air is initially evacuated from the inner chamber 22, the volume of flowable material 56 actually increases slightly as the internal air passes through it and the vacuum is created. Thus, there is actually a volume gain until the chamber is returned to atmospheric pressure.

Once the vacuum reaches the necessary level to achieve the desired deaeration of the flowable material 56, valve 52 is opened immediately. Valve 52 must be opened suddenly and fully in order to get a high impact on the material 56 from the entering air. The impact of the entering air compresses and compacts the deaerated, flowable material 56, both axially and radially, due to the internal low pressure previously created by the vacuum.

Subsequently, valve 36 is opened and the compacted, deaerated flowable material 56 flows as a compact "slug" of material into the desired container or, as illustrated, bulk bag 60. Since the compacted and deaerated material is highly densified and only drops a short distance before entering the container 60, there is very little chance of reaeration.

Finally, after the filling of the container 60 with the flowable materials 56, slide gate valve 36 closes and the vacuum fill system 10 is ready to begin a new cycle.

Figure 6:
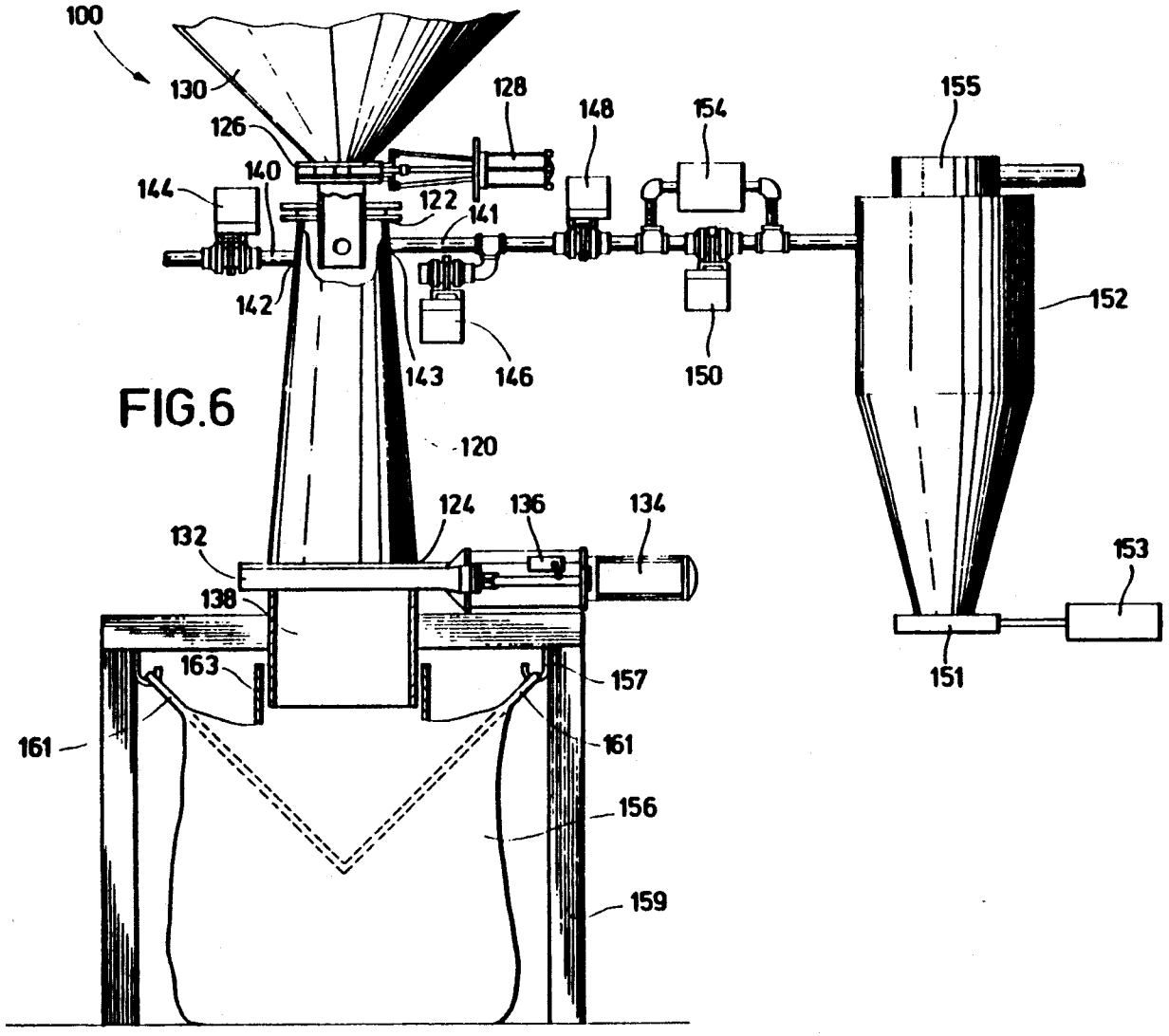
FIG. 6 is a partial sectional view of a second embodiment of the invention.

Referring now to FIG. 6, a second embodiment of the vacuum fill system 100 has a hollow, tapered chamber 120 having a first end 122 and a second end 124. Attached to the first end 122 of the hollow, tapered chamber 120 is a conventional knife or slide gate valve 126 and an associated air cylinder 128 which controls the opening and closing of the slide gate valve 126. The slide gate valve 126 and the air cylinder 128 are of conventional types well known in the art. When the slide gate valve 126 is in the open position, flowable materials flow from an input source 130 through the slide gate valve 126 into the hollow, tapered chamber 120.

At the second end 124 of the hollow, tapered chamber 120, there is a second knife or slide gate valve 132. An associated air cylinder 134 and a switch 136 are utilized to open or close the slide gate valve 132 to allow flowable materials to exit the hollow, tapered chamber 120 through a discharge chute 138 after deaeration and compaction. The slide gate valve 132, the air cylinder 134 and the switch 136 are of conventional types well known in the art.

Line 140 runs into an opening 142 in the hollow, tapered chamber 120 and is connected to a solenoid actuated butterfly valve 144 which is in turn connected to a compressed air source (not shown).

A vacuum line 141 runs into an opening 143 in the hollow, tapered chamber 120, and is connected to a series of solenoid actuated butterfly valves 146, 148, and 150, and from there to a conventional dust collector 152. The dust collector 152 has a knife or slide gate valve 151 and an associated air cylinder 153 to allow discharge of dust and particles from the dust collector. Mounted on top of the dust collector is a fan 155. Connected to the vacuum line 141 on both sides of the butterfly valve 150 is a vacuum pump or high vacuum venturi 154.

As with the first embodiment of the invention, although the vacuum fill system 100 is preferably used in connection with the filling of a semi-bulk container for handling flowable materials, it must be understood that the vacuum fill system 100 is capable of being utilized with any type of container, no matter how large or small, where it is desired to compact, deaerate, and densify the flowable materials for packing into a container for shipment and storage.

Still referring to FIG. 6, during operation of the vacuum fill system 100, a semi-bulk bag 156 is connected to the vacuum fill system 100 through conventional means such as hooks 157 mounted in a frame 159. Support loops 161 on the bag 156 are placed over the hooks 157 to suspend the bag below the discharge chute 138. A collar 163 on the bag 156 is placed around the discharge chute 138 to prevent spillage while filling the bag 156.

Before flowable materials are introduced into the hollow, tapered chamber 120, the slide gate valves 126 and 132 and the solenoid actuated butterfly valves 144, 146, and 150 are closed to allow evacuation of air from the chamber 120. The slide gate valve 126 is then opened to fill the hollow, tapered chamber 120 with flowable material. The slide gate valve 126 is then closed, the valve 148 remains open and the valve 150 is opened to initiate evacuation of air from the filled tapered chamber 120. To further evacuate the filled tapered chamber 120, the valves 146 and 150 are closed and the valve 148 remains open drawing air from the chamber 120 through action of the vacuum pump or high vacuum venturi 154.

Once the vacuum reaches the necessary level to achieve the desired deaeration of the flowable material, the valve 148 is closed and the valve 146 is opened to suddenly vent vacuum line 141 and the tapered chamber 120 to the atmosphere, thereby compacting the deaerated flowable materials within the tapered chamber 120.

The slide gate valve 132 and the valve 144 are then opened to allow compressed air to be injected into the tapered chamber 120, thereby forcing the flowable materials as a compact "slug" of material from the tapered chamber 120 and into the desired container or, as illustrated, bulk bag 156.

After the "slug" of material is ejected from the tapered chamber 120 under the force of the compressed air, the slide gate valve 132 closes and the vacuum fill system 100 is ready to begin a new cycle.

Although not shown, it should be understood that the operation of the first and second embodiments of the vacuum fill system 10 and 100 may be performed either manually or automatically through the use of conventional electronic circuitry.

Although preferred embodiments of the present invention have been illustrated in the accompanying Drawings and described in the foregoing Detailed Description, it will be appreciated by those skilled in the art that various modifications and rearrangements of the component parts and elements of the present invention are possible within the scope of the present invention.

I claim:

1. A vacuum fill system for deaerating flowable materials for storage in a container comprising:

a hollow, upwardly tapered container defining a predetermined cross-sectional area for receiving and holding the flowable materials;

a discharge outlet attached to the container and defining an opening having a cross-sectional area at least as large as the largest cross-sectional area defined by the hollow upwardly tapered container;

means for controlling the movement of the flowable material into the hollow, upwardly tapered container;

means for creating a vacuum in the hollow, upwardly tapered container for deaerating the flowable materials to temporarily suspend the flowable materials to occupy a slightly greater volume than before creation of the vacuum with the suspended materials having a uniform cross-sectional area substantially the same as the cross-sectional area defined by the hollow, upwardly tapered container;

means for returning the pressure in the hollow, upwardly tapered container to atmospheric pressure substantially instantaneously for compacting the deaerated material into a substantially solid slug of material occupying a cross-sectional area substantially identical to, but slightly smaller than the cross-sectional area defined by the hollow upwardly tapered container;

means for controlling the movement of the substantially solid slug of deaerated, compacted materials as a unitary form from the hollow, upwardly tapered container;

means for pressurizing the hollow, upwardly tapered container to force the substantially solid slug of deaerated, compacted materials to fall as a unitary form from the hollow, upwardly tapered container.

2. A vacuum fill system for deaerating flowable materials in accordance with claim 1 whereinthe means for controlling the flow of the flowable materials into the hollow, upwardly tapered container further comprises a gate valve and air cylinder attached to the container at a first end.

3. A vacuum fill system for deaerating flowable materials in accordance with claim 1 wherein the means for creating a vacuum in the hollow, upwardly tapered container for deaerating the flowable materials further comprises a plurality of valves and vacuum pump connected by a vacuum line to the hollow, upwardly container.

4. A vacuum fill system for deaerating flowable materials in accordance with claim 1 wherein the means for creating a vacuum in the hollow, upwardly tapered container for deaerating the flowable further comprises a plurality of valves and a high vacuum venturi connected by a vacuum line to the hollow, upwardly tapered container.

5. A vacuum fill system for deaerating flowable materials in accordance with claim 1 wherein the means for returning the pressure in the hollow, upwardly tapered container for compacting the deaerated flowable materials further comprises at least one valve connected by a vacuum line to the hollow, upwardly tapered container.

6. A vacuum fill system for deaerating flowable materials in accordance with claim 1 wherein the means for controlling the movement of the deaerated flowable materials as a unitary form from the hollow, upwardly tapered container further comprises a gate valve and associated air cylinder and switch attached to the hollow, upwardly tapered container at the second end.

7. A vacuum fill system for deaerating flowable materials in accordance with claim 1 wherein the means for pressurizing the hollow, upwardly tapered container to force the substantially solid slug of deaerated, compacted flowable material as a unitary form out of the hollow, upwardly tapered container further comprises at least one valve and a line connecting the valve to the hollow, upwardly tapered container for regulating the flow of compressed air into the hollow, upwardly tapered container.

8. A vacuum fill system for deaerating flowable materials for storage in a container comprising:

a hollow, upwardly tapered container defining a predetermined cross-sectional area and having first and second ends, the second end defining a cross-sectional area at least as large as the largest cross-sectional area of the hollow, upwardly tapered container;

a first gate valve and air cylinder attached to the first end of the hollow, upwardly tapered container for controlling the movement of the flowable material into the hollow, upwardly tapered container;

at least one vacuum line connected to the hollow, upwardly tapered container;

a plurality of valves each connected to the vacuum line;

vacuum means connected to the vacuum line for creating a vacuum in the hollow, upwardly tapered container for deaerating the flowable materials to temporarily suspend the flowable materials to occupy a slightly greater volume than before creation of the vacuum with the suspended materials having a uniform cross-sectional area substantially the same as the cross-sectional area defined by the hollow, upwardly tapered container;

means for returning the pressure in the hollow, upwardly tapered container to atmospheric pressure substantially instantaneously for compacting the deaerated flowable material into a substantially solid slug of material occupying a cross-sectional area substantially identical to, but slightly smaller than the cross-sectional area defined by the hollow, upwardly tapered container;

a second gate valve and air cylinder attached to the second end of the hollow, upwardly tapered container for controlling the movement of the substantially solid slug of deaerated, compacted materials as a unitary form from the hollow, upwardly tapered container; and means for pressurizing the hollow, upwardly tapered container to force the substantially solid slug of deaerated, compacted materials as a unitary form from the hollow, upwardly tapered container.

9. A vacuum fill system for deaerating flowable materials in accordance with claim 8 wherein the vacuum means comprises a high vacuum venturi.

10. A vacuum fill system for deaerating flowable materials in accordance with claim 8, wherein the means for pressurizing the hollow, upwardly tapered container for forcing the substantially solid slug of deaerated, compacted flowable materials as a unitary form from the hollow, upwardly tapered container further comprises at least one valve and a line connecting the valve to the hollow, upwardly tapered container for regulating the flow of compressed air into the hollow, upwardly tapered container.

11. A vacuum fill system for deaerating flowable materials for storage in a container comprising:

a hollow, upwardly tapered container defining a predetermined cross-sectional area for receiving and holding the flowable containers;

means for creating a vacuum in the container for deaerating the flowable materials to temporarily suspend the flowable materials to occupy a slightly greater volume than before creating of the vacuum with the suspended materials having a uniform cross-sectional area substantially the same as the cross-sectional are defined by the container;

means for returning the pressure in the container to atmospheric pressure substantially instantaneously for compacting the deaerated material into a substantially solid slug of material occupying a cross-sectional area substantially identical to, but slightly smaller than the cross-sectional area defined by the container; and a discharge outlet in the container having a discharge opening with a cross-sectional area at least as large as the largest cross-sectional area defined by the container for discharging the slug of deaerated, compacted material as a unitary form from the hollow, upwardly tapered container.

12. The vacuum fill system of claim 11, further comprising means for controlling the movement of the flowable material into the hollow, upwardly tapered container.

13. The vacuum fill system of claim 11, further comprising means for controlling the movement of the slug of deaerated, compacted material as a unitary form from the hollow, upwardly tapered container.

14. The vacuum fill system of claim 11, further comprising means for pressurizing the hollow, upwardly tapered container to force the slug of deaerated, compacted material to fall as a unitary form from the hollow, upwardly tapered container.

15. The vacuum fill system of claim 11, wherein the means for creating a vacuum in the first container for deaerating the flowable material further comprises a plurality of valves and a vacuum pump connected to the first container.

* * * * *